US012473685B2

(12) United States Patent
Bellinger et al.

(10) Patent No.: US 12,473,685 B2
(45) Date of Patent: Nov. 18, 2025

(54) FOREIGN PARTICULATE ALGORITHM FOR A LAUNDRY APPLIANCE

(71) Applicant: WHIRLPOOL CORPORATION, Benton Harbor, MI (US)

(72) Inventors: Ryan Robert Bellinger, St. Joseph, MI (US); Timothy Noah Blatchley, Stevensville, MI (US); Mark Jason Christensen, Stevensville, MI (US); Ryan Douglas Kuhn, St. Joseph, MI (US); Wesley Paul Traylor, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 406 days.

(21) Appl. No.: 17/860,401

(22) Filed: Jul. 8, 2022

(65) Prior Publication Data

US 2023/0058390 A1 Feb. 23, 2023

Related U.S. Application Data

(60) Provisional application No. 63/234,819, filed on Aug. 19, 2021.

(51) Int. Cl.
*D06F 58/22* (2006.01)
*D06F 58/36* (2020.01)

(52) U.S. Cl.
CPC ..... *D06F 58/22* (2013.01); *D06F 58/36* (2020.02)

(58) Field of Classification Search
CPC ..... D06F 58/22; D06F 58/36; D06F 58/44; D06F 2101/20; D06F 2105/24; D06F 2105/30; D06F 2105/46; D06F 2105/48
See application file for complete search history.

(56) References Cited

U.S. PATENT DOCUMENTS

| | | | | |
|---|---|---|---|---|
| 5,701,684 | A | 12/1997 | Johnson | |
| 7,921,578 | B2 | 4/2011 | McAllister et al. | |
| 9,157,177 | B2 | 10/2015 | Buendia et al. | |
| 2014/0259448 | A1 * | 9/2014 | Alexander | D06F 35/005 68/12.18 |
| 2020/0071873 | A1 | 3/2020 | Kang et al. | |

FOREIGN PATENT DOCUMENTS

| | | | | |
|---|---|---|---|---|
| CN | 102535132 B | * 10/2013 | | D06F 58/28 |
| CN | 109338691 | 2/2019 | | |
| EP | 2735642 A1 | * 5/2014 | | D06F 58/28 |
| WO | 2008119475 | 10/2008 | | |

OTHER PUBLICATIONS

Translation, CN-102535132-B (Year: 2013).*

* cited by examiner

*Primary Examiner* — Jessica Yuen
(74) *Attorney, Agent, or Firm* — Price Heneveld LLP

(57) ABSTRACT

A laundry appliance includes a cabinet having a user interface. A drum is disposed within the cabinet and is operably coupled to a motor that rotates the drum. A blower delivers process air through an airflow path that includes the drum. A controller is communicatively coupled to the user interface, the motor, and the blower. The controller is configured to selectively operate a foreign particulate cycle that includes at least a soft-start feature.

6 Claims, 8 Drawing Sheets

A Method 400 for Operating a Laundry Appliance for Removing and Collecting Foreign Particulate, Including Pet Hair

FOREIGN PARTICULATE ALGORITHM FOR A LAUNDRY APPLIANCE

CROSS-REFERENCE TO RELATED APPLICATION

This application claims priority to and the benefit under 35 U.S.C. § 119(e) of U.S. Provisional Patent Application No. 63/234,819, filed on Aug. 19, 2021, entitled FOREIGN PARTICULATE ALGORITHM FOR A LAUNDRY APPLIANCE, the entire disclosure of which is hereby incorporated herein by reference.

BACKGROUND OF THE DISCLOSURE

The present disclosure generally relates to a laundry appliance, and more specifically, to a foreign particulate algorithm for a laundry appliance.

SUMMARY OF THE DISCLOSURE

According to one aspect of the present disclosure, a laundry appliance includes a cabinet having a user interface. A drum is disposed within the cabinet and is operably coupled to a motor that rotates the drum. A blower delivers process air through an airflow path that includes the drum. A controller is communicatively coupled to the user interface, the motor, and the blower. The controller is configured to selectively operate a foreign particulate cycle that includes at least a soft-start feature.

According to another aspect of the present disclosure, a laundry appliance includes a drum disposed within a cabinet and is operably coupled to a motor that rotates the drum. A blower delivers process air through an airflow path that includes the drum. A controller is communicatively coupled to a user interface, the motor, and the blower. The controller is configured to selectively operate a foreign particulate cycle that includes a soft-start feature and an airflow speed routine and at least one of a speed modulating routine and a drum rotation routine.

According to yet another aspect of the present disclosure, a method for operating a laundry appliance for removing and collecting foreign particulate, including pet hair includes disposing articles to be processed within a rotating drum. A foreign particulate cycle is selected using a user interface. A soft-start routine is operated wherein a rotational speed of the drum gradually increases from a full stop to a full operating speed over a predetermined period of time. A drum modulation routine is operated after the drum reaches the full operating speed. The drum modulation routine includes at least one of a drum rotation routine and a drum speed modulation routine. The foreign particulate cycle is completed. Foreign particulate is removed from a particulate filter.

These and other features, advantages, and objects of the present disclosure will be further understood and appreciated by those skilled in the art by reference to the following specification, claims, and appended drawings.

Figure 1:
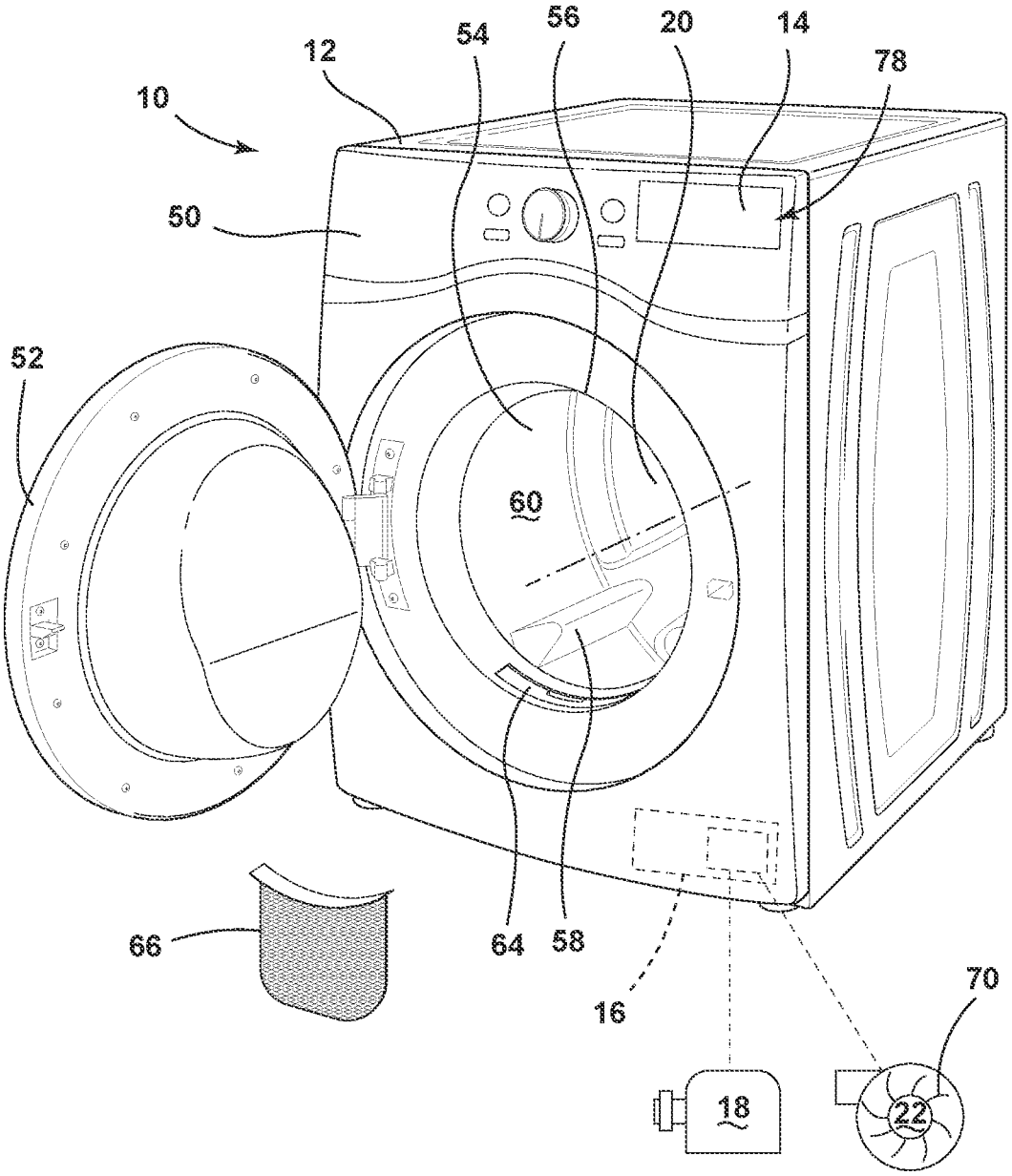
FIG. 1 is a side perspective view of a laundry appliance of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a foreign particulate algorithm. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-8, reference numeral 10 generally designates a laundry appliance that includes a cabinet 12 having a user interface 14 and defining a machine compartment 16. A motor 18 is disposed within the machine compartment 16, and a drum 20, such as a rotating drum, is disposed within the cabinet 12. The drum 20 is operably coupled to the motor 18. A blower 22 is proximate to the machine compartment 16 and operably coupled with the drum 20. The blower 22 directs process air 24 through an airflow path that includes the drum 20. A controller 26 is communicatively coupled to the user interface 14, the motor 18, and the blower 22. The controller 26 includes a foreign particulate cycle 28 that is configured with a soft-start feature 30. The foreign particulate cycle 28 is also configured with a foreign particulate algorithm 32 that includes a drum speed modulation routine 34 and a drum rotation routine 36. The speed modulation routine 34 can be performed by altering or modulating an electrical current that is delivered to or drawn by the motor 18 that rotationally operates the drum 20.

Figure 2:
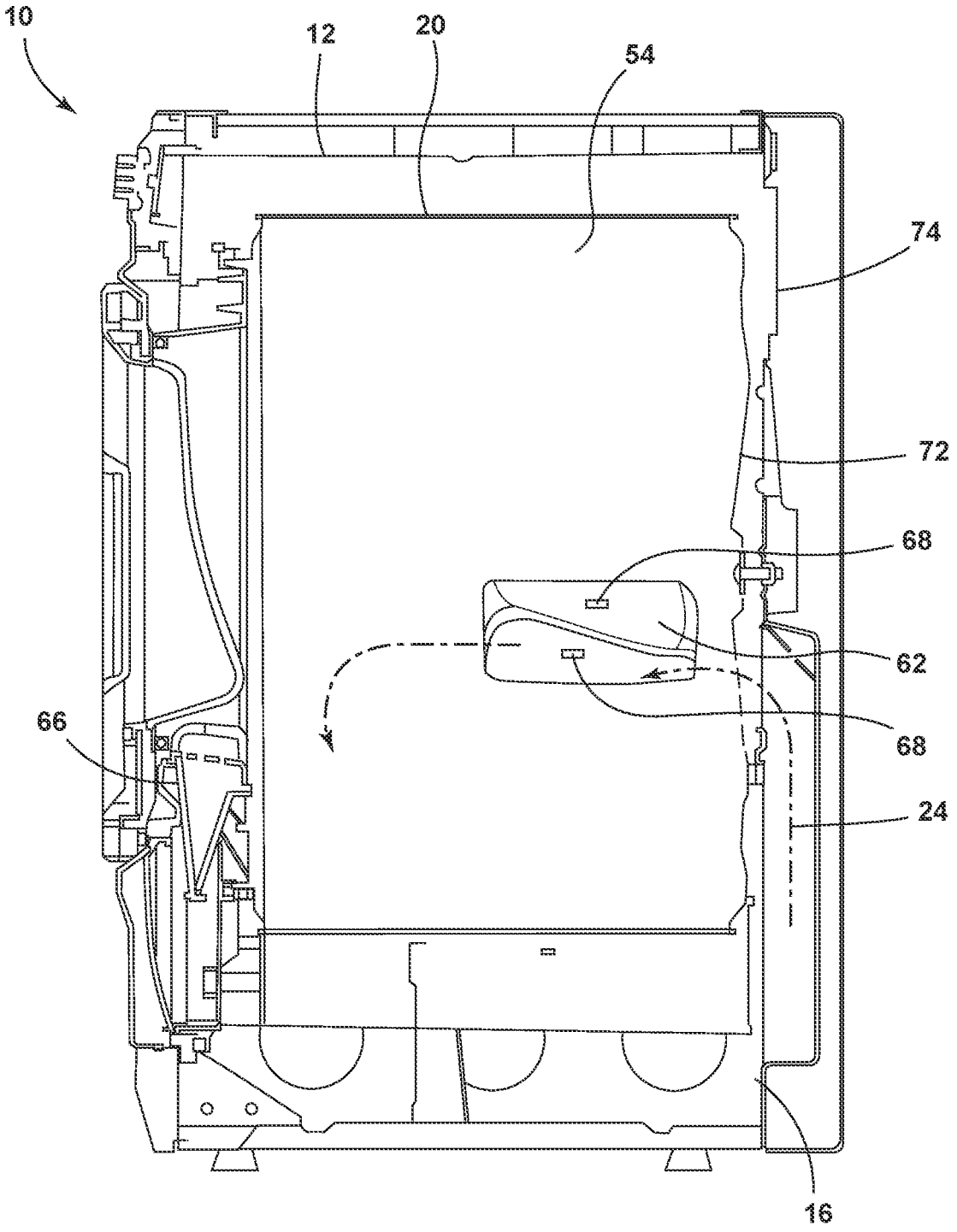
FIG. 2 is a side cross-sectional view of a laundry appliance of the present disclosure with an airflow defined in a laundry cavity.
Figure 3:
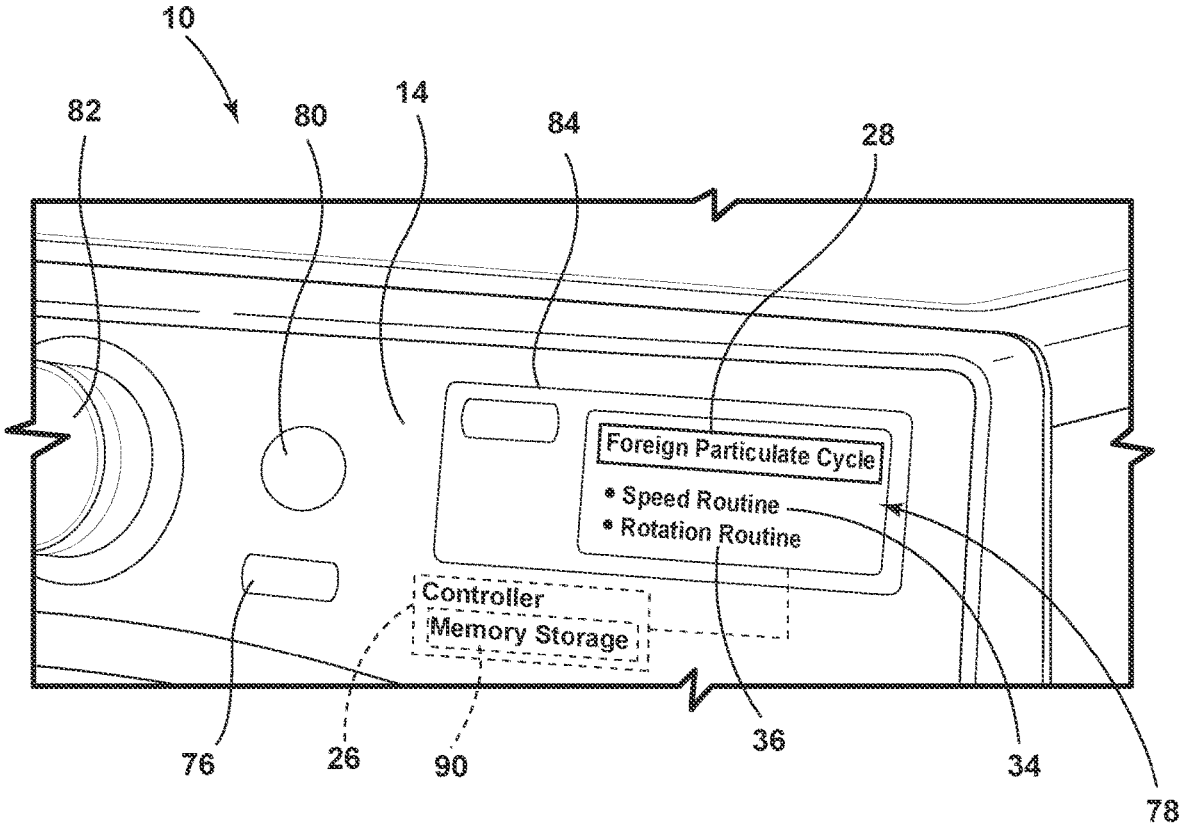
FIG. 3 is an enlarged partial side perspective view of a user interface of the present disclosure displaying a foreign particulate cycle.

Referring now to FIGS. 1-3, the laundry appliance 10 is illustrated as a dryer having a front panel 50 on which the user interface 14 is disposed. It is generally contemplated that the laundry appliance 10 may be referred to herein as a laundry dryer. It is also contemplated that the laundry appliance 10 may be a washer, a dryer, and/or a combination washer and dryer. The laundry appliance 10 includes a door 52 operably coupled to the cabinet 12 to provide selective access to a laundry cavity 54 defined by the drum 20. The drum 20 is disposed within the cabinet 12, proximate to the door 52, such that the door 52 is positioned proximate to an opening 56 defined by the cabinet 12. The opening 56 generally provides the user access into the laundry cavity 54 defined by the drum 20. It is generally contemplated that the drum 20 includes baffles 58 coupled to and extending from sidewalls 60 of the drum 20. The baffles 58 are configured to lift and otherwise tumble clothing items 62 within the laundry cavity 54. As described in further detail herein, the lifting and tumbling of the clothing items 62 by the baffles 58 assists in a drying function of the laundry appliance 10.

The cabinet 12 also has a slot 64 defined by the front panel 50, and a foreign particulate collector 66 that can be selectively disposed within the slot 64. It is also contemplated that the slot 64 may be defined in any practicable location within the laundry appliance 10 to collect foreign particulates 68 within the process air 24 that moves through an airflow path within the laundry cavity 54. As illustrated in FIG. 1, the foreign particulate collector 66 is depicted as a lint filter. The foreign particulate collector 66 may have various configurations, shapes, and features configured to collect and retain the foreign particulates 68 within and/or on the foreign particulate collector 66. The foreign particulates 68 may be accumulated on the clothing items 62 and may include particulates such as pet hair, lint, and/or other particulates that may accumulate on the clothing items 62.

With further reference to FIGS. 1-3, the blower 22 can be partially disposed within the machine compartment 16 and may be positioned proximate to the drum 20. The blower 22 may include a fan 70 that assists in directing the process air 24 into the laundry cavity 54. The process air 24 from the blower 22 and directed by the fan 70 is configured to engage the clothing items 62 throughout a laundry cycle, either consistently and/or intermittently. The blower 22 and the fan 70 assist in maintaining a temperature of the laundry cavity 54 during the foreign particulate cycle 28, described further herein. The blower 22 projects the process air 24 into the drum 20 typically via a rear ventilation plate 72. The rear ventilation plate 72 is operably coupled to a rear panel 74 of the laundry appliance 10 proximate to the drum 20. The blower 22 directs the process air 24 through the rear ventilation plate 72 to circulate within the laundry cavity 54. The process air 24 passes over and/or through the clothing items 62 within the laundry cavity 54 to, ultimately, dry the clothing items 62.

The respective laundry cycle can be selected via the user interface 14 depicted with various interface portions 76. The interface portions 76 may include a touchscreen 78, buttons 80 disposed along the user interface 14, and/or a knob 82, proximate to the buttons 80. It is contemplated that the user interface 14 also includes a display 84, which may include the touchscreen 78, to assist the user in selecting a laundry cycle. Additionally or alternatively, the laundry cycle may be selected via the knob 82 that can be communicatively coupled with the controller 26. It is further contemplated that using the interface portions 76 of the user interface 14, the controller 26 may be activated via voice activation and/or via remote communication, as described herein. The controller 26 is configured with various laundry cycle algorithms that may be activated or selected via the interface portion 76, that include tactile controls, voice activation, remote activation, and/or other practicable activation methods. The laundry algorithms may include, but are not limited to, daytime cycles, time-saving cycles, and/or the foreign particulate cycle 28. As discussed herein, the foreign particulate cycle 28 is configured with the foreign particulate algorithm 32.

The controller 26 includes a memory storage 90 in which the various laundry cycle algorithms, including the foreign particulate cycle 28, may be stored. For example, the memory storage 90 includes the foreign particulate algorithm 32 and the corresponding speed modulation routine 34 and the drum rotation routines 36. The controller 26 may also be configured with a processor 92 and other control circuitry. The foreign particulate algorithm 32 is stored within the memory storage 90 and executed by the processor 92. The other control circuitry of the controller 26 may include communication circuitry 94 for multi-directional communication. For example, the controller 26 may be communicatively coupled with a remote user device 96 via the communication circuitry 94. It is generally contemplated that the remote user device 96 may receive remote notifications 98 from the controller 26 via the communication circuitry 94. While the memory storage 90 can be included within the controller 26, other remotely accessible memory interfaces can also be used instead of or in combination with the memory storage 90.

The user interface 14, sometimes referred to as a communications interface, may be a wireless interface, such that the laundry appliance 10 and the remote user device 96 are configured to emit wireless signals. The communication interface may correspond to a variety of communication protocols configured to distribute data among various electronic devices. For example, the communication interface may include an IEEE 802.11 connection, an IEEE 802.15 connection, a Bluetooth® connection, a Wi-Fi connection, a WiMAX connection, cellular signal, signal using shared wireless access protocol cord axis (SWAP-CA), or any other type of radiofrequency or wireless signal. An IEEE 802.15 connection includes any wireless personal area networks (WPAN), such as ZigBee®, Z-Wave®, Bluetooth®, UWB, and IrDA. In this way, the communication interface may provide for data communication between the controller 26 and the remote user device 96. The remote user device 96 may be, for example, a phone, a tablet, a computer, a wearable device, or other electronic devices.

With reference to FIGS. 1-8, the controller 26 is configured with the foreign particulate algorithm 32, which is configured to assist in removing the foreign particulates 68 from the clothing items 62 within the laundry cavity 54. The foreign particulate algorithm 32 can alter a rotational speed and/or the rotational direction of the drum 20 via selective activation of the motor 18. For example, the controller 26 may modify the rotational speed of the drum 20 during the foreign particulate cycle 28 by slowing or increasing the output speed of the motor 18. The reduced speed of the drum 20 assists in uncoupling the foreign particulates 68 from the clothing items 62 within the laundry cavity 54, as described further herein.

The foreign particulate algorithm 32 of the foreign particulate cycle 28 is configured with the speed modulation routine 34 and/or the drum rotation routine 36. Stated differently, the foreign particulate algorithm 32 may be configured with the speed modulation routine 34, the rotation routine 36 of the drum 20, and/or both the speed modulation routine 34 and the rotation routine 36 of the drum 20. The laundry appliance 10 receives the clothing items 62 within the laundry cavity 54 defined by the drum 20, and the clothing items 62 are rotated within the drum 20 during the foreign particulate cycle 28. It is generally contemplated that the clothing items 62 may contain the foreign particulates 68, such as pet hair, disposed thereon. As described in more detail herein, the foreign particulates 68 are configured to be removed during the foreign particulate cycle 28. The clothing items 62 are tumbled within the laundry cavity 54 during the foreign particulate cycle 28 to assist in removal of the foreign particulates 68.

With further reference to FIGS. 1-5, the user may activate at least one of the speed modulation routine 34 and/or the drum rotation routine 36 via the controller 26 by selecting the foreign particulate cycle 28. The user may select the foreign particulate cycle 28, which may present both the speed modulation routine 34 and the drum rotation routine 36 to the user via the user interface 14. Additionally or alternatively, the selection of the foreign particulate cycle 28 may automatically activate at least one of the speed modulation routine 34 and/or the drum rotation routine 36. It is generally contemplated that the speed modulation routine 34 is configured to engage and disengage the motor 18 and the blower 22. The speed modulation routine 34 is configured to adjust and/or alter the speed of at least the drum 20 to assist in the removal of the foreign particulate 68 from the clothing items 62. For example, the user may select the speed modulation routine 34, upon selection of the foreign particulate cycle 28, which may temporarily increase and/or decrease the rotational speed of the drum 20. Additionally or alternatively, the speed modulation routine 34 may be configured to intermittently increase and decrease the speed of the drum 20.

In addition to the foreign particulate algorithm 32, the foreign particulate cycle 28 may be configured with the soft-start feature 30. The soft-start feature 30 is configured to cooperate with the controller 26 to slowly increase the speed of the drum 20. The slow activation of the drum 20 via the motor 18 during the soft-start feature 30 can assist in removal of the foreign particulates 68. Additionally or alternatively, the soft-start feature 30 may assist in minimizing the overall operational noise of the laundry appliance 10 during the foreign particulate cycle 28. It is also contemplated that the controller 26 may be configured to detect a load within the drum 20 to automatically activate the foreign particulate cycle 28 and/or other laundry cycles. The soft-start feature 30 is typically operated during an initial phase of the foreign particulate cycle 28. This initial phase of the soft-start feature 30 can operate over the course of a predetermined period of time. This predetermined period of time can range from approximately 30 seconds to approximately 10 minutes. The soft-start feature 30 operates to rotate the drum 20 from a full stop, where the drum 20 is at rest and not rotating, to a full-operating speed over the course of the predetermined period of time. The full operating speed can be characterized as one of the first rotational speed or the second rotational speed, depending on the laundry cycle or the foreign particulate cycle 28 that has been selected by the user.

Referring still to FIGS. 1-5, the speed modulation routine 34 is executed via the controller 26 altering the motor 18 to increase and/or decrease the speed of the drum 20 and/or the fan 70 of the blower 22. It is generally contemplated that the speed modulation routine 34 can be configured with a motor speed routine 100 and an airflow speed routine 102, as described herein. The motor speed routine 100 includes the alteration of the rotational speed of the drum 20 via the controller 26 and motor 18. The motor speed routine 100 assists in gently agitating the clothing items 62 within the laundry cavity 54. The clothing items 62 are lifted by the baffles 58 and dropped within the laundry cavity 54 due to the altered speed of the drum 20 by the motor 18. As a result of the altered speed of the drum 20, the drum 20 may rotate at a first rotational speed that is greater than a second rotational speed. The clothing items 62 rotate within the drum 20 at the first rotational speed and can then transition to the second rotational speed to drop the clothing items 62 within the laundry cavity 54. The shift in rotation of the clothing items 62 via transition from the first rotational speed to the second rotational speed assists in loosening and/or removing the foreign particulates 68 from the clothing items 62. It is also contemplated that the first rotational speed may be a faster speed than the second rotational speed, such that the speed modulation routine 34 may decrease the rotational speed of the drum 20.

Figure 4:
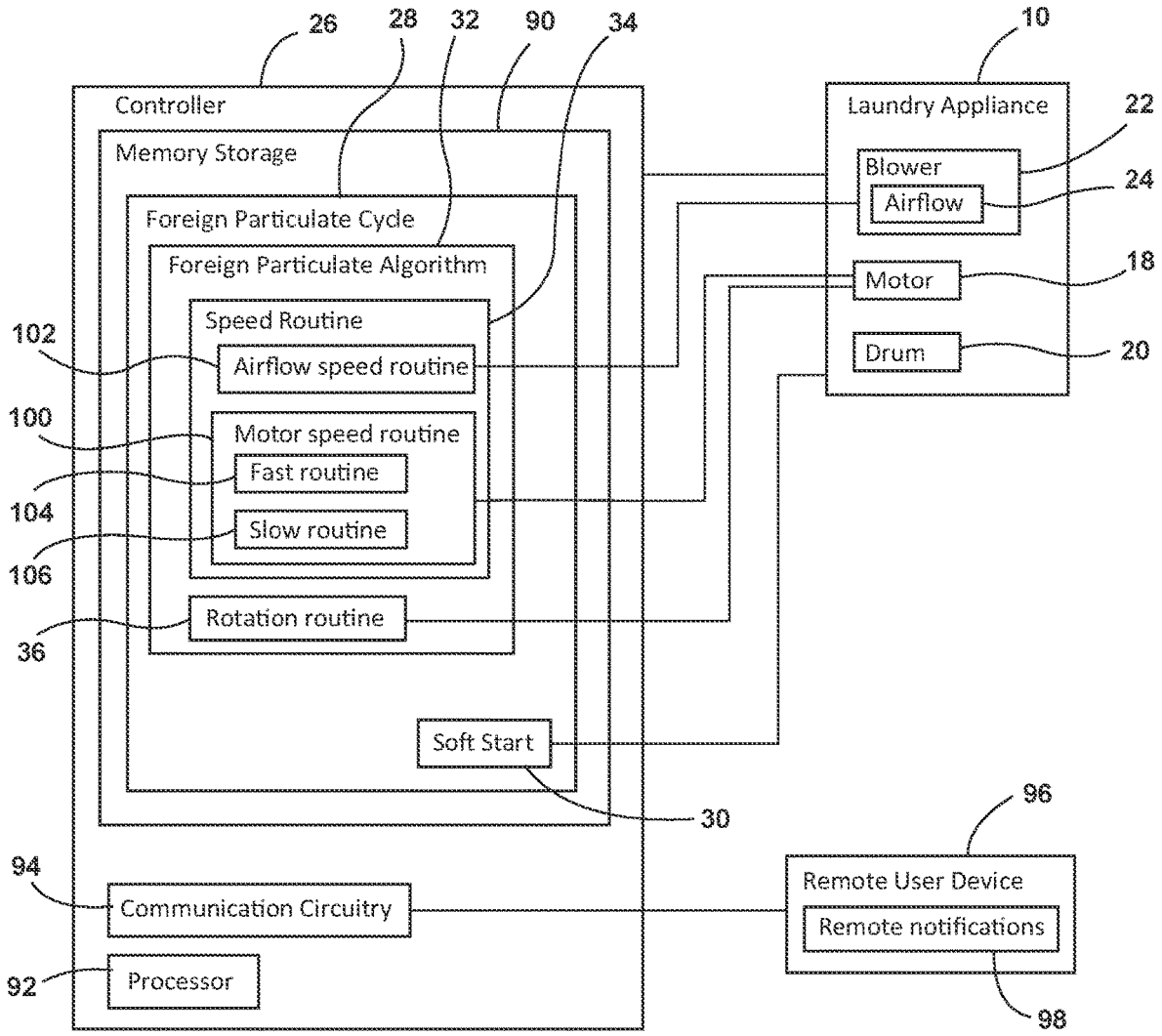
FIG. 4 is an exemplary schematic block diagram of a controller with a foreign particulate cycle of the present disclosure.
Figure 5:
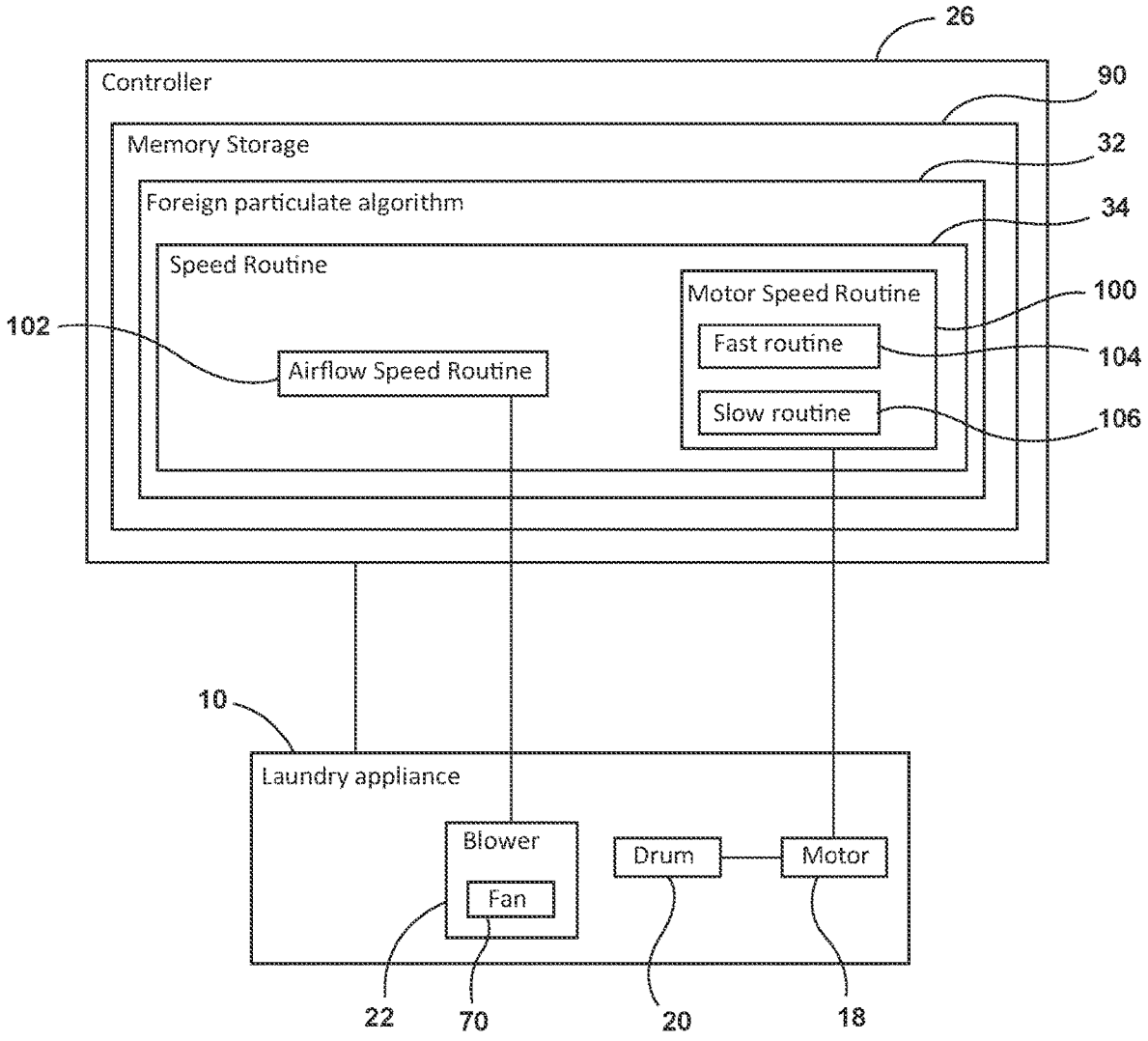
FIG. 5 is an exemplary schematic block diagram of a controller with a speed routine of the present disclosure.
Figure 6:
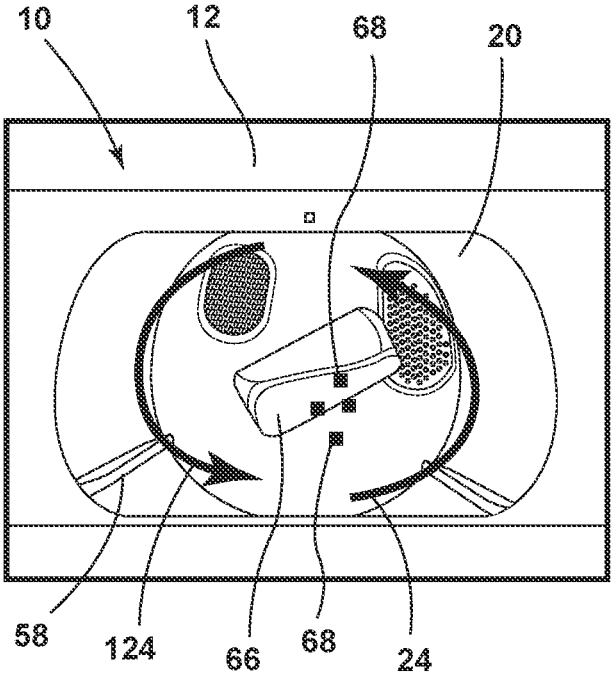
FIG. 6 is an enlarged partial front elevational view of a laundry cavity with clothing items and schematically depicting a rotational direction of a drum of the present disclosure.
Figure 7:
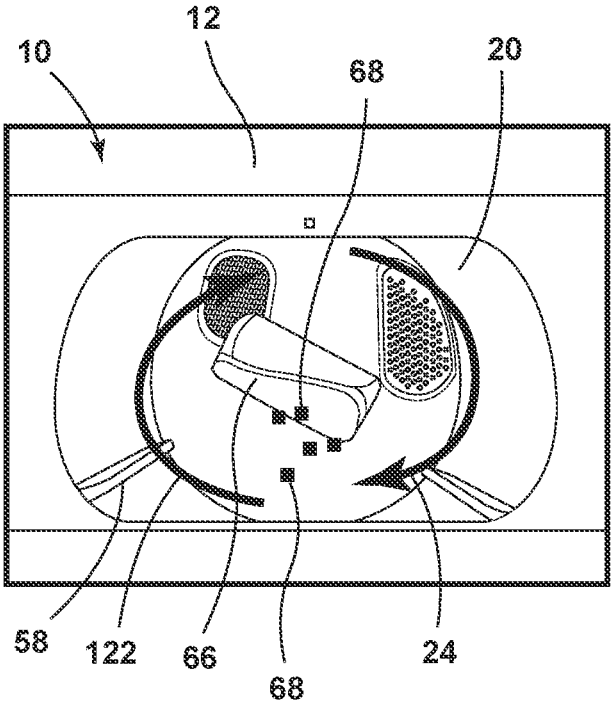
FIG. 7 is an enlarged partial front elevational view of the laundry cavity of FIG. 6 with the clothing items and schematically depicting an opposite rotational direction of the drum of the present disclosure.
Figure 8:
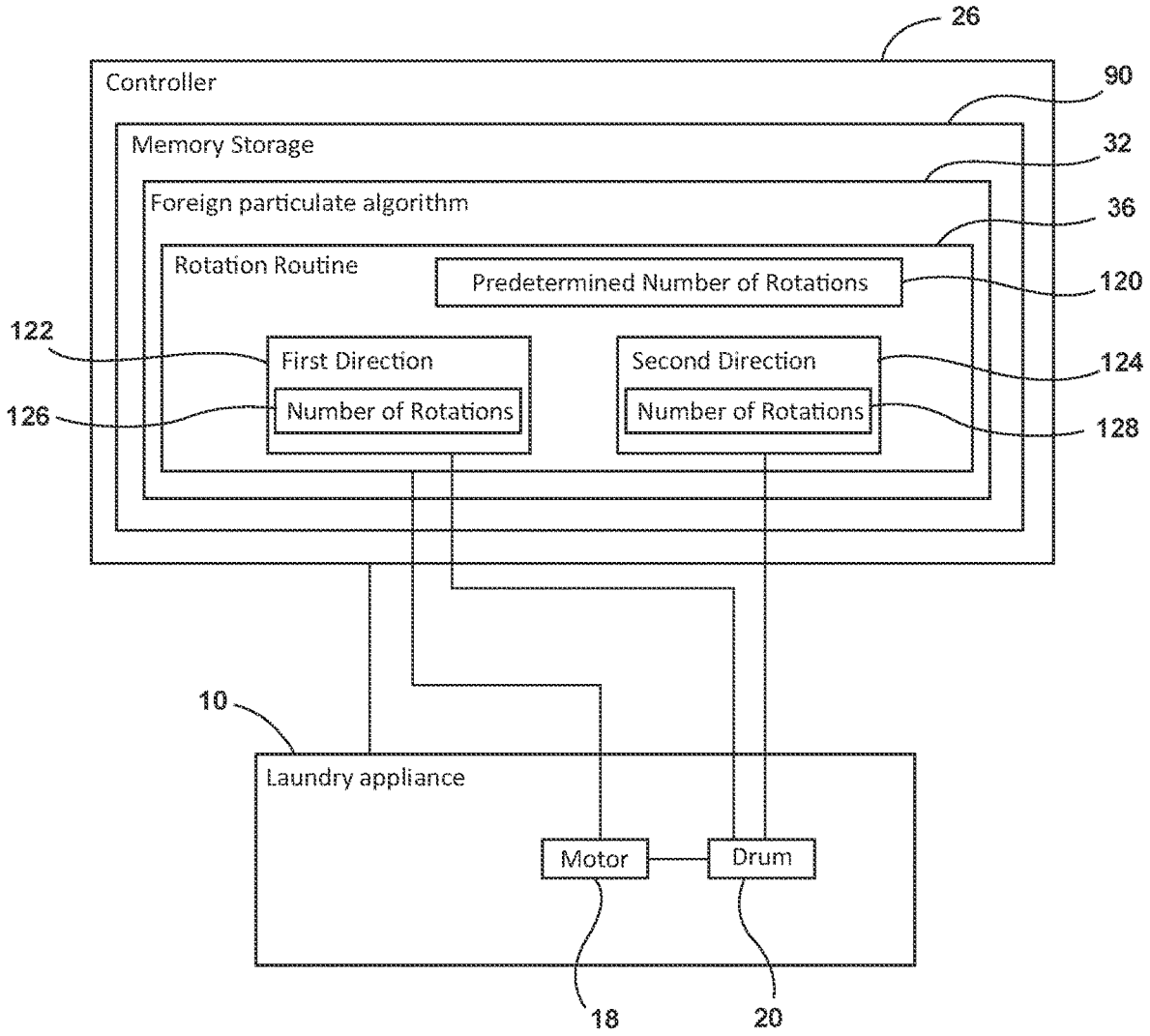
FIG. 8 is an exemplary schematic block diagram of a controller with a rotation routine of the present disclosure.
Figure 9:
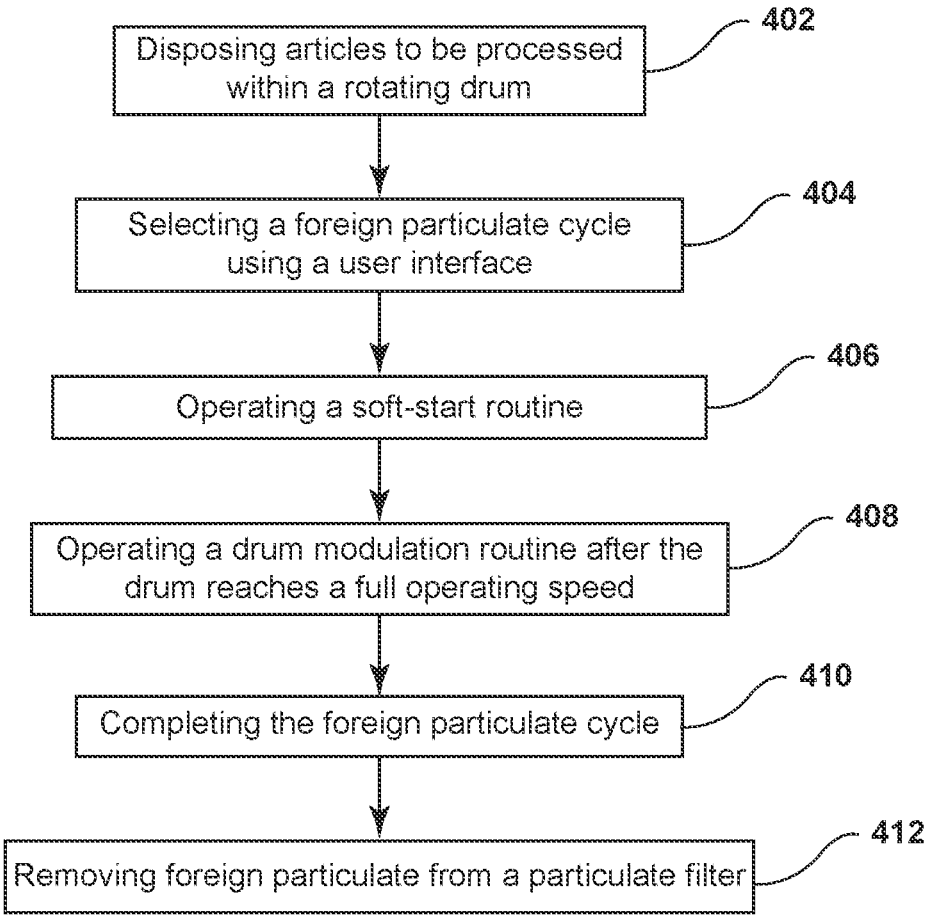
FIG. 9 is a linear flow diagram illustrating a method for operating a foreign particulate cycle of a laundry appliance.

Referring still to FIGS. 3-5, the motor speed routine 100 can be configured with the option of a fast routine 104 and/or a slow routine 106 of the motor 18. It is generally contemplated that the fast routine 104 is configured, such that the first rotational speed of the motor 18 is slower than the second rotational speed of the motor 18. During the fast routine 104, the speed of the drum 20 is increased via the motor 18, at least temporarily, from the first rotational speed to the second rotational speed. The fast routine 104 may be configured as a time-saving routine, such that the increased of speed of the drum 20 can assist in both removing the foreign particulates 68 and may decrease the drying time of the clothing items 62. Additionally or alternatively, the slow routine 106 may alter the speed of the drum 20 by decreasing the speed of the drum 20 from the first rotational speed to the second rotational speed.

Regardless of the motor speed routine 100 selected, the motor speed routine 100 alters the overall rotational speed of the drum 20 to remove the foreign particulate 68 from the clothing items 62. The speed reduction of the drum 20 may further increase the gentle agitation of the clothing items 62, which may release additional foreign particulates 68 to be collected by the foreign particulate collector 66. As the rotational speed of the drum 20 is altered during the foreign particulate cycle 28, the foreign particulates 68 may be released from the clothing items 62 and enter the process air 24. The process air 24 then directs the foreign particulates 68 toward the foreign particulate collector 66 to generally trap and retain the foreign particulates 68.

With further reference to FIGS. 1-5, it is also contemplated that the speed modulation routine 34 may be configured to control the speed of the blower 22 via the airflow speed routine 102 to modify and alter the process air 24 within the laundry cavity 54. For example, the controller 26 may be configured to communicate with the blower 22 to alter the speed and/or the direction of the process air 24 within the laundry cavity 54. The speed of the process air 24 within the laundry cavity 54 may be increased to gently agitate and remove the foreign particulates 68 from the clothing items 62. It is generally contemplated that the altered speed of the process air 24 may be identified on the user interface 14 as the airflow speed routine 102. The airflow speed routine 102 may be selected separately from the motor speed routine 100. In certain aspects of the device, the blower 22 can be operated using the motor 18. In such an aspect of the device, modifications in the rotational speed of the drum 20 similarly affect the speed of the process air 24 moving through the airflow path. It is also contemplated that the blower 22 can operate independently of the motor 18 and the drum 20 through the use of a dedicated fan motor. Where the dedicated fan motor is used, the process air 24 can be delivered through the drum at a consistent rate throughout the foreign particulate cycle 28. In addition, as described herein, the speed of the process air 24 can also be adjusted to perform an airflow speed routine 102 of the foreign particulate cycle 28.

It is also contemplated that the motor speed routine 100 and and/or the airflow speed routine 102 may be executed during a portion of the foreign particulate cycle 28 that is separate from the drying cycle and/or the rotation routine 36. The airflow speed routine 102 may be configured to intermittently increase and decrease the speed of the process air 24 within the laundry cavity 54 to gently agitate the clothing items 62 as the intermittent configuration may alternatively be configured as an on-off cycle of the blower 22, such that the blower 22 is activated and deactivated by the controller 26.

Referring to FIGS. 1, 2, and 6-8, the foreign particulate algorithm 32 is configured with the rotation routine 36 that can be configured to rotate the drum 20 in an alternating pattern, such as a predetermined alternating pattern, of a predetermined number of rotations 120 that are conducted in each of a first direction 122 and a second direction 124 to maximize the removal of the foreign particulates 68 from the clothing items 62. Stated differently, the rotation routine 36 may rotate the drum 20 in a single direction for the predetermined number of rotations 120 before the drum rotation routine 36 alters the direction of the drum 20 rotation. For example, the drum 20 may switch between the first direction 122 and the second direction 124. It is generally contemplated that the first direction 122 may correspond to a clockwise direction 122, and the second direction 124 may correspond to a counterclockwise direction 124. The drum 20 may rotate in the clockwise direction 122 for a first predetermined number of rotations 126. The controller 26 may alter the direction to the counterclockwise direction 124 after the first predetermined number of rotations 126 for a second predetermined number of rotations 128.

The altered rotational direction of the drum 20 may gently agitate the clothing items 62 to release the foreign particulates 68. The altered rotation assists in maximizing the contact between the clothing items 62 and the baffles 58 of the drum 20. This maximized contact further loosens and assists in the removal of the foreign particulates 68 from the clothing items 62. The drum 20 rotates in the first direction 122 and is altered to the second direction 124 via the controller 26. The clothing items 62 may fall or otherwise rest within the drum 20 after the predetermined number of rotations 120 during the transition between the first direction 122 and the second direction 124. The application of gravitational force upon the clothing items 62 within the drum 20 during the transition between the first and second directions 122, 124 assists in gently agitating and altering the rhythmic rotation of the clothing items 62 within the drum 20, such that additional foreign particulates 68 may be removed from the clothing items 62.

Referring now to FIGS. 1-9, having described various aspects of the appliance and the foreign particulate cycle 28, a method 400 is disclosed for operating a foreign particulate cycle 28 of a laundry appliance. According to the method 400, step 402 includes disposing articles to be processed within a rotating drum 20. Step 404 includes selecting a foreign particulate cycle 28 using a user interface. In certain aspects of the device, the appliance can include multiple versions of the foreign particulate cycle 28. These versions can account for varying levels of particulate, type of particulate, such as pet hair, and other variables. According to the method 400, step 406 includes operating a soft-start routine. As described herein, the soft-start routine occurs during an initial phase of the foreign particulate cycle 28. In the soft-start routine, the rotational speed of the drum 20 gradually increases from a full stop to a full operating speed over a predetermined period of time. After the soft-start routine is complete, or substantially complete, step 408 includes operating a drum modulation routine after the drum 20 reaches the full operating speed. As described herein, the drum modulation routine includes at least one of a drum rotation routine 36 and a drum speed modulation routine 34. During the soft-start routine and the drum modulation routine, the particulate filter of the appliance is capturing the foreign particulates that are released from the articles being processed in the drum 20. Step 410 of the method 400 includes completing the foreign particulate cycle 28. The foreign particulate is then removed from a particulate filter (step 412).

Referring again to FIGS. 1-8, the foreign particulate cycle 28 assists in maximizing the removal of the foreign particulates 68 from the clothing items 62 via at least one of the speed modulation routine 34 and the rotation routine 36. The speed modulation routine 34 alters the speed of the motor 18 and/or the blower 22 to gently agitate and release the foreign particulates 68 from the clothing items 62. The speed modulation routine 34 may also assist in advancing a drying time of the laundry appliance 10 by increasing the speed of the process air 24 within the laundry cavity 54. The rotation routine 36 assists in removing the foreign particulates 68 from the clothing items 62 by rotating and altering the position and engagement of the clothing items 62 within the laundry cavity 54 with the baffles 58 to release the foreign particulates 68 from the clothing items 62. This can be accomplished by an oscillating motion of the drum 20, through periodic changes in direction of the rotation of the drum 20, periodic stoppages in rotation of the drum 20, combinations thereof and other variations in the operation of the drum 20.

According to another aspect of the present disclosure, a laundry appliance includes a cabinet having a user interface. A drum is disposed within the cabinet and is operably coupled to a motor that rotates the drum. A blower delivers process air through an airflow path that includes the drum. A controller is communicatively coupled to the user interface, the motor, and the blower. The controller is configured to selectively operate a foreign particulate cycle that includes at least a soft-start feature.

According to another aspect, the foreign particulate cycle includes a speed modulation routine.

According to yet another aspect, the speed modulation routine includes varying a speed of the drum between a first rotational speed and a second rotational speed after completion of the soft-start feature. The first rotational speed is faster than the second rotational speed.

According to another aspect of the present disclosure, the controller operates the speed modulation routine by altering an electrical current that is delivered to the motor.

According to another aspect, the foreign particulate cycle includes a rotation routine that is configured to alter a rotation of the drum between a clockwise direction and a counterclockwise direction during the foreign particulate cycle.

According to yet another aspect, the soft-start feature is configured to slowly increase a speed of the drum through an initial phase of the foreign particulate cycle.

According to another aspect of the present disclosure, the initial phase of the foreign particulate cycle is approximately 10 minutes.

According to another aspect, the speed modulation routine and the rotation routine are performed contemporaneously.

According to yet another aspect, the speed modulation routine and the rotation routine are performed after completion of the soft-start feature.

According to another aspect of the present disclosure, the blower operates using a dedicated fan motor that operates independently of the motor for the drum. The dedicated fan motor is in communication with the controller.

According to another aspect, process air is delivered through the drum at a consistent rate throughout the foreign particulate cycle.

According to yet another aspect, the foreign particulate cycle includes an airflow speed routine that modulates a speed of the process air that is delivered through the drum. The speed of the process air is modulated by adjusting the speed of the dedicated fan motor.

According to another aspect of the present disclosure, the rotation routine includes a predetermined alternating pattern of rotating the drum a predetermined number of rotations in the clockwise direction and the counterclockwise direction.

According to another aspect, a laundry appliance includes a drum disposed within a cabinet and is operably coupled to a motor that rotates the drum. A blower delivers process air through an airflow path that includes the drum. A controller is communicatively coupled to a user interface, the motor, and the blower. The controller is configured to selectively operate a foreign particulate cycle that includes a soft-start feature and an airflow speed routine and at least one of a speed modulating routine and a drum rotation routine.

According to yet another aspect, the speed modulation routine includes varying a speed of the drum between a first rotational speed and a second rotational speed after completion of the soft-start feature. The first rotational speed is faster than the second rotational speed.

According to another aspect of the present disclosure, the drum rotation routine is configured to alter a rotation of the drum between a clockwise direction and a counterclockwise direction during the foreign particulate cycle.

According to another aspect, the soft-start feature is configured to increase a speed of the drum over a predetermined period of time.

According to yet another aspect, the airflow speed routine modulates the speed of process air that is delivered through the drum. A speed of the process air is modulated by adjusting an operating speed of the blower.

According to another aspect of the present disclosure, a method for operating a laundry appliance for removing and collecting foreign particulate, including pet hair includes disposing articles to be processed within a rotating drum. A foreign particulate cycle is selected using a user interface. A soft-start routine is operated wherein a rotational speed of the drum gradually increases from a full stop to a full operating speed over a predetermined period of time. A drum modulation routine is operated after the drum reaches the full operating speed. The drum modulation routine includes at least one of a drum rotation routine and a drum speed modulation routine. The foreign particulate cycle is completed. Foreign particulate is removed from a particulate filter.

According to another aspect, the foreign particulate cycle includes an airflow speed routine that operates during the soft-start routine and the drum modulation routine. The airflow speed routine modulates a speed of process air that is delivered through the drum.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:

a drum disposed within a cabinet and operably coupled to a motor that rotates the drum;

a blower that delivers process air through an airflow path that includes the drum; and a controller communicatively coupled to a user interface, the motor, and the blower, wherein the controller is configured to selectively operate a foreign particulate cycle that includes a soft-start feature and an airflow speed routine and at least one of a speed modulating routine and a drum rotation routine that operate to agitate articles within the drum to separate foreign particulate from the articles, wherein the airflow speed routine operates independently of the speed modulating routine and the drum rotation routine, wherein the airflow speed routine directs the foreign particulate to a particulate filter, wherein the controller operates the airflow speed routine, the speed modulating routine, and the drum rotation routine based upon an identified type of foreign particulate, and wherein the controller includes a plurality of routines of the foreign particulate cycle that relate to the identity of the type of foreign particulate that is present on the articles.

2. The laundry appliance of claim 1, wherein the speed modulation routine includes varying a speed of the drum between a first rotational speed and a second rotational speed after completion of the soft-start feature, wherein the first rotational speed is faster than the second rotational speed.

3. The laundry appliance of claim 1, wherein the drum rotation routine is configured to alter a rotation of the drum between a clockwise direction and a counterclockwise direction during the foreign particulate cycle.

4. The laundry appliance of claim 1, wherein the soft-start feature is configured to increase a speed of the drum over a predetermined period of time.

5. The laundry appliance of claim 1, wherein the airflow speed routine modulates the speed of process air that is delivered through the drum, wherein a speed of the process air is modulated by adjusting an operating speed of the blower.

6. The laundry appliance of claim 1, wherein the drum includes baffles that assist in agitating the articles within the drum to separate the foreign particulate from the articles.

* * * * *